US006021969A

United States Patent [19]

Schmitt et al.

[11] Patent Number: 6,021,969

[45] Date of Patent: Feb. 8, 2000

[54] AGITATOR MILL

[75] Inventors: Philipp Schmitt, Eampertheim; Norbert Stehr, Grünstadt, both of Germany

[73] Assignee: Draiswerke GmbH, Mannheim, Germany

[21] Appl. No.: 09/300,396

[22] Filed: Apr. 27, 1999

[30] Foreign Application Priority Data

May 5, 1998 [DE] Germany ..... 198 19 967

[51] Int. Cl.[7] ..... B02C 17/16

[52] U.S. Cl. ..... 241/171; 241/172; 241/179

[58] Field of Search ..... 241/170, 171, 241/172, 179, 180, 79

[56] References Cited

U.S. PATENT DOCUMENTS

| | | | |
|---|---|---|---|
| 4,304,362 | 12/1981 | Buhler . | |
| 4,620,673 | 11/1986 | Canepa et al. . | |
| 5,062,577 | 11/1991 | Schmitt et al. . | |
| 5,133,508 | 7/1992 | Stehr et al. . | |
| 5,785,262 | 7/1998 | Tippett | 241/74 |
| 5,894,998 | 4/1999 | Schall et al. | 241/79 |
| 5,897,068 | 4/1999 | Stehr | 241/171 |

FOREIGN PATENT DOCUMENTS

| | | |
|---|---|---|
| 73 15 932 | 9/1974 | Germany . |
| 26 31 623 | 1/1978 | Germany . |
| 40 02 613 | 8/1991 | Germany . |
| 196 38 354 | 3/1998 | Germany . |
| WO 86/02286 | 4/1986 | WIPO . |
| WO 90/07378 | 7/1990 | WIPO . |

*Primary Examiner*—John M. Husar
*Attorney, Agent, or Firm*—Browdy and Neimark

[57] ABSTRACT

An agitator mill comprises an annular cylindrical exterior grinding chamber, which is defmed by an inner wall of a grinding receptacle and an outer wall of a rotor and an interior grinding chamber, which is defined by an inner wall of the rotor and an outer jacket of an interior stator. The grinding chambers are interconnected by a deflection chamber. Allocated to the interior stator is a separating device which comprises inner annular disks rotatingly drivably coupled with the rotor and outer annular disks non-rotarily connected to the interior stator.

12 Claims, 6 Drawing Sheets c
52
83'
70'
88
66'
35'
72'
91
81'
52
70a'
82'
74'
71'
75'
68'
20
59
69'
73'
67'
68'
74'
70'
90
e
61'
89
91
87
81'
65'
64'
63'
63'
34'
60'

AGITATOR MILL

BACKGROUND OF THE INVENTION

1. Field of the Invention

The invention relates to an agitator mill for the treatment of free flowing grinding stock, comprising a grinding receptacle, which defines a substantially closed grinding chamber partially filled with auxiliary grinding bodies; and an agitator unit, which is disposed rotatingly drivably in the grinding receptacle and is cup-shaped relative to a common central longitudinal axis and which comprises an annular cylindrical rotor, within which is disposed an interior stator joined to the grinding receptacle, a grinding stock supply line opening into the grinding chamber outside the rotor, a grinding stock/auxiliary grinding body separating device being mounted on the interior stator within the rotor, to which separating device a grinding stock discharge line is connected, the separating device having outer annular disks and inner annular disks, which alternate with one another in the direction of the central longitudinal axis, defining separating gaps between them, the width of which is less than the diameter of the auxiliary grinding bodies.

2. Background Art

An agitator mill of the generic type is known for instance from U.S. Pat. No. 5,062,577. In this agitator mill, which has been extraordinarily successful in practice, the inner annular disks and the outer annular disks are mounted against rotation.

U.S. Pat. No. 4,304,362 teaches an agitator mill which comprises a separating device formed by a separating gap at the grinding stock outlet, this separating gap being formed between a disk disposed on a driving shaft of the agitator unit and a stationary cover.

DE 26 31 623 C2 teaches an agitator mill comprising an agitator unit with a shaft on which agitator disks are mounted. Inner annular disks are fixed against rotation on this shaft. An outer annular disk is disposed for free flotation between two neighboring inner annular disks so that the separating gaps may adjust freely between an outer annular disk and an adjoining inner annular disk at a time.

DE 196 38 354 A1 teaches an agitator mill having an agitator unit which is disposed to be driven in rotation in a grinding receptacle and which is cup-shaped relative to a common central longitudinal axis, having an annular cylindrical rotor within which an interior stator is disposed which is connected to the grinding receptacle. A separating sieve is mounted within and on the rotor and is sealed towards the interior stator by means of a seal. This seal in the form of a slide ring seal comprises two coaxial slide rings which bear against each other by spring loading. It is the purpose of this design to avoid clogging of the separating sieve.

SUMMARY OF THE INVENTION

It is an object of the invention to improve an agitator mill of the generic type so that clogging of the separating device is precluded even under extreme conditions of operation.

According to the invention, this object is attained by the features wherein the inner annular disks are fixed to a rotary body, which is rotary about the central longitudinal axis; and wherein the outer annular disks are non-rotary; and wherein the rotary body is rotatingly drivably coupled with the rotor. Agglomerates of grinding stock are ground by high shear forces in the gaps between the rotating inner annular disk and the stationary outer ring disks. Pseudoplastic grinding stock experiences a reduction of viscosity in the gaps so that the pressure drop at the separating device is reduced.

When the rotary body is provided with at least one coupling member and the inner front side, facing same, of the rotor is provided with at least one opposite coupling member, which can be engaged and disengaged by a motion of the rotor relative to the separating device in the direction of the central longitudinal axis, this reflects an especially simple embodiment of how to produce or release the coupling for rotary drive between the rotary body of the separating device and the rotor. In particular, a plug-in coupling formed between the rotor and the separating device is especially advantageous.

Possibilities of how to mount the separating device on the interior stator consist in that the separating device is extractable outwards out of the interior stator and in that the separating device is tightly but releasably connected to the interior stator.

Further features, advantages and details of the invention will become apparent from the ensuing description of an exemplary embodiment of the invention, taken in conjunction with the drawing.

DESCRIPTION OF THE PREFERRED EMBODIMENT

Figure 1:
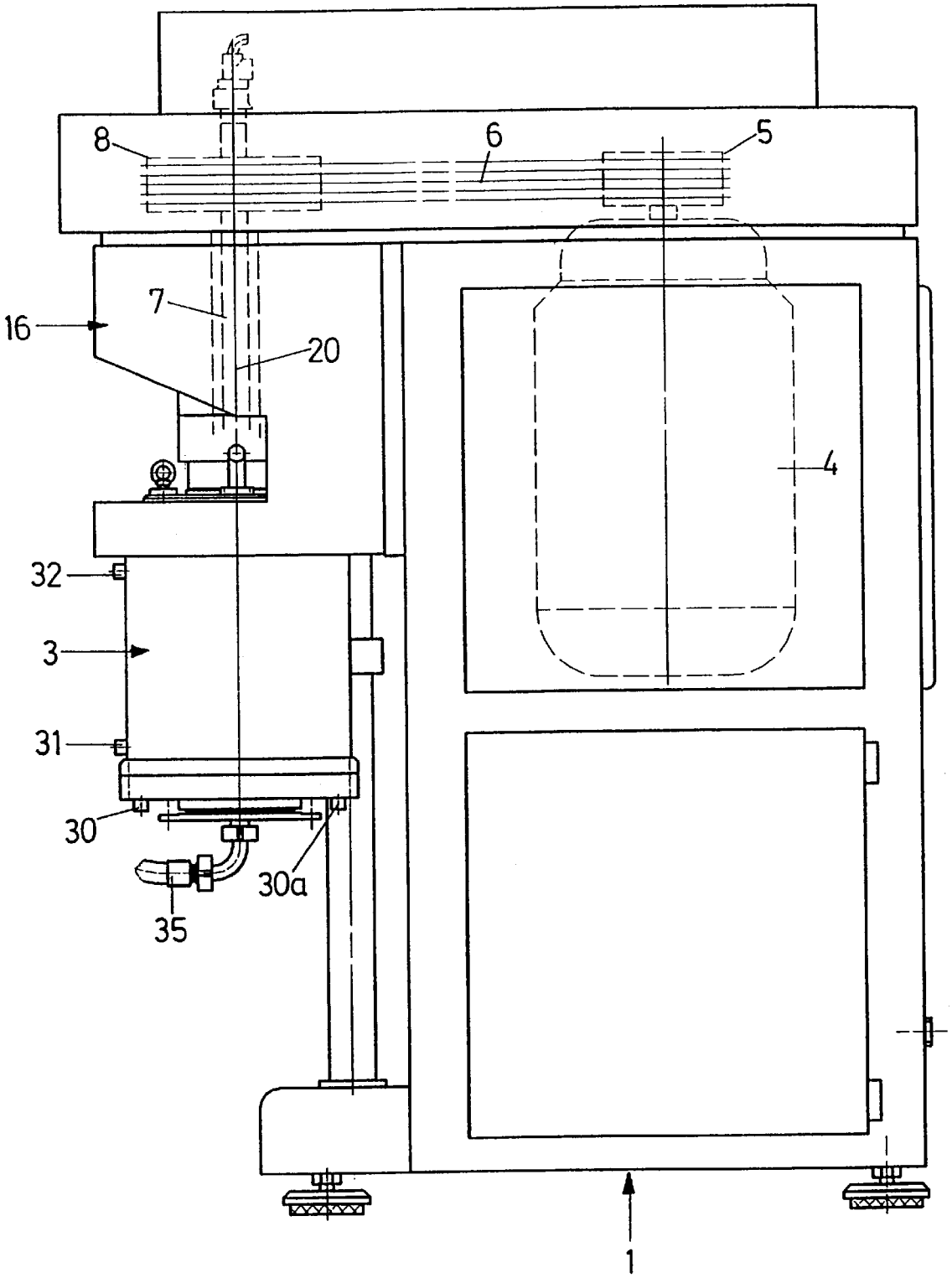
FIG. 1 is a diagrammatic representation of a lateral view of an agitator mill.

The agitator mill seen in FIG. 1 customarily comprises a stand 1 on which to mount a cylindrical grinding receptacle 3. An electric driving motor 4 is housed in the stand 1 and is provided with a V-belt pulley 5 by means of which a V-belt pulley 8 can be driven in rotation by way of V-belts 6, the V-belt pulley 8 being non-rotatably united with a driving shaft 7.

Figure 2:
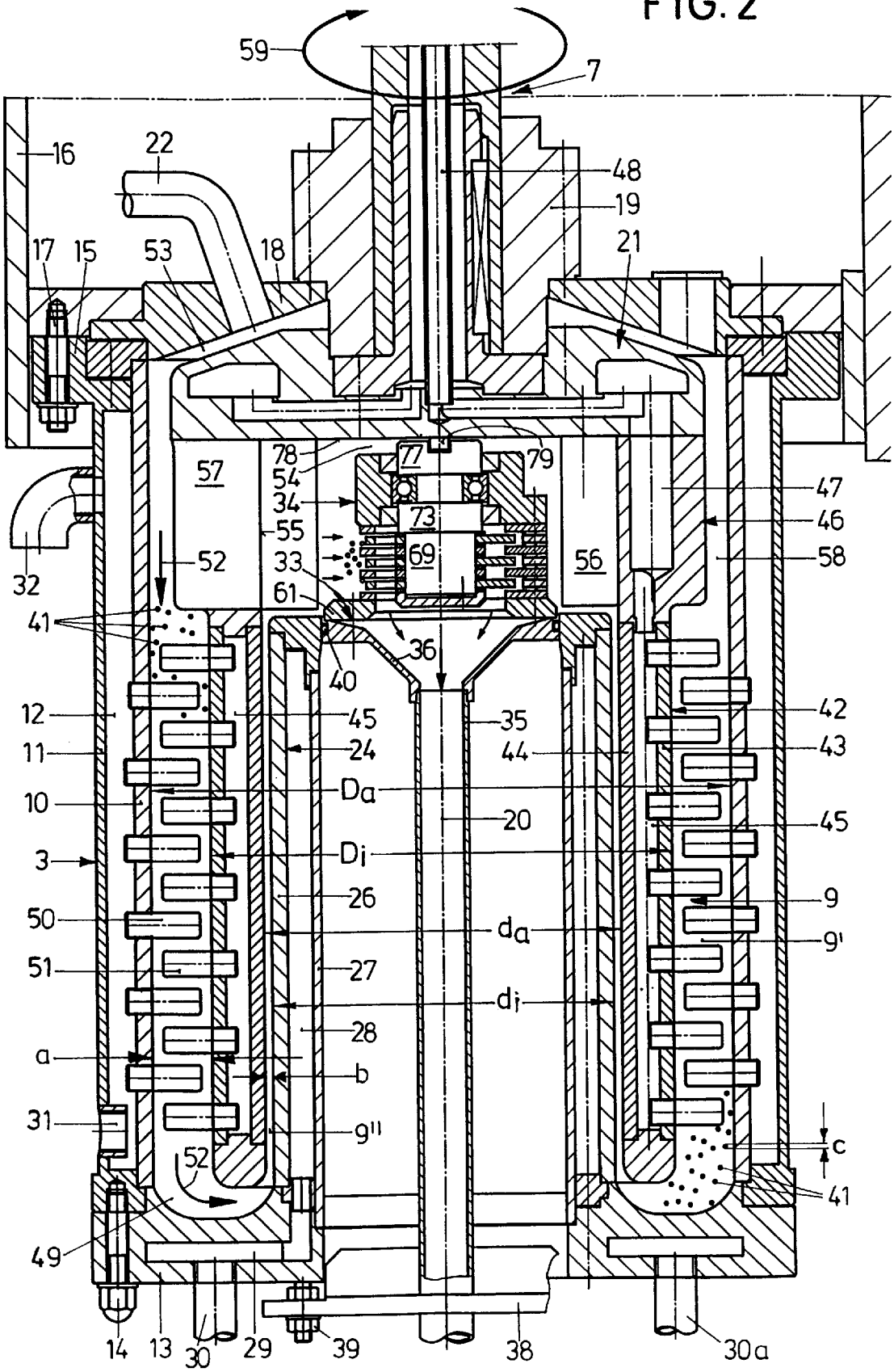
FIG. 2 is a lengthwise section through the grinding receptacle of the agitator mill.

As seen in particular in FIG. 2, the grinding receptacle 3 consists of a cylindrical inner wall 10 which surrounds a grinding chamber 9 and which is enveloped by a substantially cylindrical outer jacket 11. Between them, the interior cylinder 10 and the outer jacket 11 define a cooling chamber 12. The lower end of the grinding chamber 9 is formed by a bottom plate 13 in the form of a circular ring which is fixed to the grinding receptacle by means of screws 14.

The grinding receptacle 3 comprises an upper annular flange 15, by means of which it is fixed to the underside of a carrying housing 16 by way of screws 17, the carrying housing 16 being attached to the stand 1 of the agitator mill. The grinding chamber 9 is closed by means of a cover 18. The carrying housing 16 possesses a central bearing and sealing housing 19 which is disposed coaxially to the central longitudinal axis 20 of the grinding receptacle 3. The driving shaft 7 passes through this sealing housing 19, the shaft 7 equally being coaxial to the axis 20 and having an agitator unit 21 attached to it. A grinding stock supply line 22 opens into the portion of the sealing housing 19 that adjoins the grinding chamber 9.

An approximately cup-shaped, cylindrical interior stator 24 is fixed to the bottom plate 13 in the form of an annulus, projecting into the grinding chamber 9 and comprising a cylindrical outer jacket 26, which is coaxial to the axis 20 and defines the grinding chamber 9, and a cylindrical inner jacket 27, which is also coaxial to the axis 20. The outer jacket 26 and the inner jacket 27 define between them a cooling chamber 28. The cooling chamber 28 is connected with a cooling chamber 29 in the bottom plate 13, cooling water being supplied to the cooling chamber 29 by way of a cooling water supply connector 30 and discharged by way of a cooling water discharge connector 32. The cooling chamber 12 of the grinding receptacle 3 is supplied with cooling water via a cooling water supply connector 31, the cooling water being discharged via a cooling water discharge connector 32.

A separating device 34 is disposed on the upper front side 33, located above the grinding chamber 9, of the interior stator 24 and is connected with a grinding stock discharge line 35. Since this separating device 34 has the function of grinding stock/auxiliary grinding body separation in conventional embodiments, it is designated as a separating device 34 here too, although it fulfills this function only under extreme conditions of operation. A grinding stock collecting hopper 36 is provided between the separating device 34 and the discharge line 35. In the vicinity of the bottom plate 13, the discharge line 35 is provided with a holding bow 38 which, by means of screws 39, is detachably joined to the bottom plate 13 and the interior stator 24 that is tightly connected with the latter. The separating device 34 is sealed towards the annular front side 33 of the interior stator 24 by means of a seal 40 and, together with the discharge line 35 and the collecting hopper 36, can be pulled downwards out of the interior stator 24 once the screws 39 are loosened. The separating device 34 can be pulled out of the grinding chamber 9 without the auxiliary grinding bodies 41 housed therein having to be removed from the grinding chamber, since the level of filling of the grinding chamber 9 with these auxiliary grinding bodies 41 does not reach as far as to the front side 33 when the agitator unit 21 is not driven.

The basic structure of the agitator unit 21 is cup-shaped, i.e. the latter comprises a substantially annular cylindrical rotor 42 which is formed by a cylindrical outer wall 43 and a cylindrical inner wall 44 disposed coaxially thereto and coaxially to the axis 20. A cooling chamber 45 is formed between the outer wall 43 and the inner wall 44 of the rotor 42. The rotor 42 is mounted on a rotor carrying member 46 which is joined to the shaft 7. The cooling water supply to, and its discharge from, the cooling chamber 45 takes place by way of cooling water channels 47, 48 formed in the shaft 7 and in the rotor carrying member 46. By means of the interior cylinder 10 of the grinding receptacle 3 and the cylindrical outer wall 43 of the rotor 42 on the one hand, and by means of the cylindrical inner wall 44 of the rotor 42 and the cylindrical outer jacket 26 of the interior stator 24 on the other hand, the grinding chamber 9 is divided into a cylindrical exterior grinding chamber 9' one the one hand and a cylindrical interior grinding chamber 9" on the other hand, the two being connected with each other by a deflection chamber 49 in the vicinity of the bottom plate 13.

On the walls defining the grinding chamber which are constituted by the interior cylinder 10 and the outer wall 43, provision is made for stationary agitator elements 50, which project into the exterior grinding chamber 9', and agitator elements 51 rotary together with the rotor 42. By contrast, no agitator elements that project into the interior grinding chamber 9" are mounted on the walls defining the grinding chamber which are constituted by the inner wall 44 and the outer jacket 26. The grinding stock flows through the grinding chamber 9 in accordance with the arrows 52 of flow direction, coming from the grinding stock supply line 22, through a grinding stock supply chamber 53 between the rotor carrying member 46 on the one hand and the cover 18 and the neighboring portion of the interior wall 10 on the other, through the exterior grinding chamber 9' downwards, through the deflection chamber 49 radially inwards, and from there through the interior grinding chamber 9" upwards as far as to the separating device 34. On its way through the exterior grinding chamber 9', the deflection chamber 49 and the interior grinding chamber 9", the grinding stock is ground while the agitator unit 21 is driven in rotation, cooperating with the auxiliary grinding bodies 41. The grinding stock leaves the grinding chamber 9 through the separating device 34, from where it discharges through the grinding stock discharge line 35.

The separating device 34 is disposed in a cylindrical recess 54 of the rotor carrying member 46. Between the cylindrical wall 55 of the recess 54 and the separating device 34, elongated drivers 56 are mounted on the wall 55, which are approximately triangular in cross-sectional shape and which, between themselves, form inlet portions of approximately hopper-type cross-sectional shape for bypasses 57. A design of this type with these drivers 56 is known from U.S. Pat. No. 5,133,508.

The bypasses 57 are situated in the rotor carrying member 46, i.e. in the portion of transition of the rotor carrying member 46 to the cylindrical rotor 42 and—seen in the direction of the arrows of flow direction 52—before the separating device 34. Related to the flow direction corresponding to the arrows of flow direction 52, they connect the end of the interior grinding chamber 9" with the beginning of the exterior grinding chamber 9', i.e. with a transition portion 58 of the grinding stock supply chamber 53 which passes into the exterior grinding chamber 9'. Related to the direction of rotation 59 of the agitator unit 21, the bypasses 57 extend radially from the inside to the outside against the direction of rotation 59 so that the auxiliary grinding bodies 41, which are provided with centrifugal acceleration in the interior grinding chamber 9", are catapulted off through the bypasses 61 and thus returned again into the grinding stock supply chamber 53.

With the agitator elements 51 mounted on the rotor 42 and the stationary counterpart agitator elements 50 mounted on the grinding receptacle 3, the exterior grinding chamber 9' is a genuine grinding chamber in which the auxiliary grinding bodies 41 are exposed to intensive momentum exchange with the rotating agitator elements 51 and the stationary agitator elements 50, i.e. in which the grinding stock is subjected to an intensive shearing and dispersing process by impact effects. The individual particles of the grinding stock supplied in the form of a dispersion or suspension are intensively comminuted in the exterior grinding chamber 9'. As opposed to this, the interior grinding chamber 9" is embodied as a grinding gap, the cross-sectional surface of which is considerably smaller than the cross-sectional surface of the exterior grinding chamber 9'. The exterior grinding chamber 9' possesses an outside diameter Da and an inside diameter Di. The interior grinding chamber 9" in the form of a grinding gap possesses an outside diameter da and an inside diameter di.

The ratios of the cross-sectional surfaces of the exterior grinding chamber 9' and the interior grinding chamber 9" are of no importance within the scope of this invention. As for possible ratios of the cross-sectional surfaces, reference is made to U.S. patent application Ser. No. 09/172,887 now U.S. Pat. No. 5,897,068. This reference also applies to the width a of the exterior grinding chamber 9' radial to the axis 20 and to the gap width b of the interior grinding chamber 9" equally radial to the axis 20. As an upper limit, $c \leqq 1.5$ mm applies to the diameter c of the auxiliary grinding bodies 41.

Figure 3:
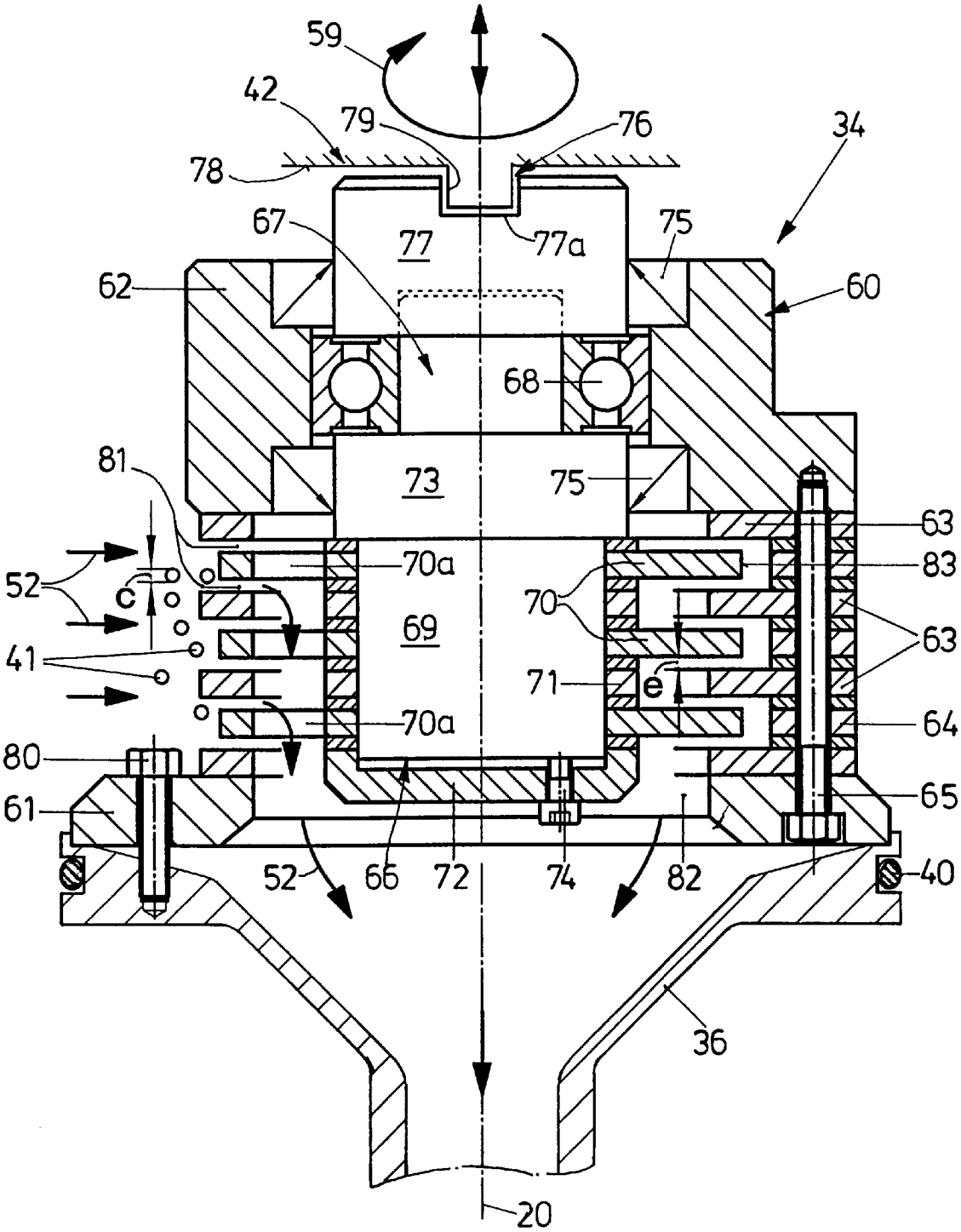
FIG. 3 is a lengthwise section, on an enlarged scale, through the grinding stock/auxiliary grinding body separating device of the agitator mill according to FIG. 2.

The design of the separating device 34 can be seen in particular from FIG. 3. The separating device 34 comprises a housing 60 which has a bottom flange 61 and a flange-type cover 62. Outer annular disks 63 are disposed at a distance from each other between the bottom flange 61 and the flange-type cover 62, this distance being ensured by spacers 64. Radially to the central longitudinal axis 20, the outer annular disks 63 extend inwards beyond the spacers 64. The flange-type cover 62, the outer annular disks 63 with the spacers 64 placed in between and the bottom flange 61 are screwed together by means of screws 65, forming the housing 60.

Further, the separating device 34 comprises a rotary body 66 which has a short shaft 67 which is lodged by means of a bearing 68 in the flange-type cover 62 for free rotation relative thereto. On a journal 69 of the shaft 67, inner annular disks 70 with openings 70a are disposed at a distance from each other, to which end spacers 71 are disposed between them. The inner annular disks 70 with the spacers 71 between them are fixed against an annular collar 73 of the shaft 67 in the direction of the axis 20 by means of a clamping cover 72, to which end the clamping cover 72 is screwed against the shaft journal 69 by means of screws 74. The bearing 68 and thus also the shaft 67 are sealed towards the flange-type cover 62 by means of seals 75. Mounting the separating device 34 is effected by outer annular disks 63 and spacers 64 and inner annular disks 70 and spacers 71 being alternately stacked one above the other, assembly by means of the screws 65 and the screws 74 taking place only subsequently.

The shaft 67 of the separating device 34 can be joined to the rotor 42 by means of a plug-in coupling 76 for positive drive in rotation. To this end, the shaft 67 has a coupling member 77 with a groove 77*a*. On the inner front side 78, turned thereto, of the rotor 42, provision is made for an opposed coupling member 79 in the form of a bar which matches the groove 77*a* of the coupling member 77 in shape and engages therewith. The housing 60 is fixed on the collecting hopper 36 of the discharge line 35 by means of screws 80 which are screwed in through the bottom flange 61. Since the separating device 34 does not project beyond the collecting hopper 36 radially to the axis 20, i.e. since it does not have an outer diameter that exceeds the inner jacket 27 of the interior stator 24, the separating device 34 can be pulled out of the grinding receptacle 3 together with the discharge line 35, whereby the connection between the coupling members 77 and 79 is released. Upon renewed insertion of the discharge line 35 with the separating device 34, the connection of the plug-in coupling 76 is again restored.

The distance e between an inner annular disk 70 and an outer annular disk 63 is smaller than the diameter c of the auxiliary grinding bodies 41. $0.1c \leqq e \leqq 0.7c$ applies. The grinding stock enters the interior 82 of the separating device 34 through the separating gaps 81 formed in each case between neighboring outer annular disks 63 and inner annular disks 70, running off through the openings 70*a* and then through the collecting hopper 36 and the discharge line 35. As a result of the specified gap width e, any auxiliary grinding bodies 41 that might exceptionally arrive before the separating device 34 are retained. They are additionally catapulted off outwards radially to the axis 20 by the inner annular disks 70 which rotate at the speed of the agitator unit 21, since tangential acceleration is exercised on the auxiliary grinding bodies 41 by the peripheries 83 of the inner annular disks 70. Any clogging of the separating device 34 by auxiliary grinding bodies 41 under extreme conditions of operation is therefore precluded.

Figure 4:
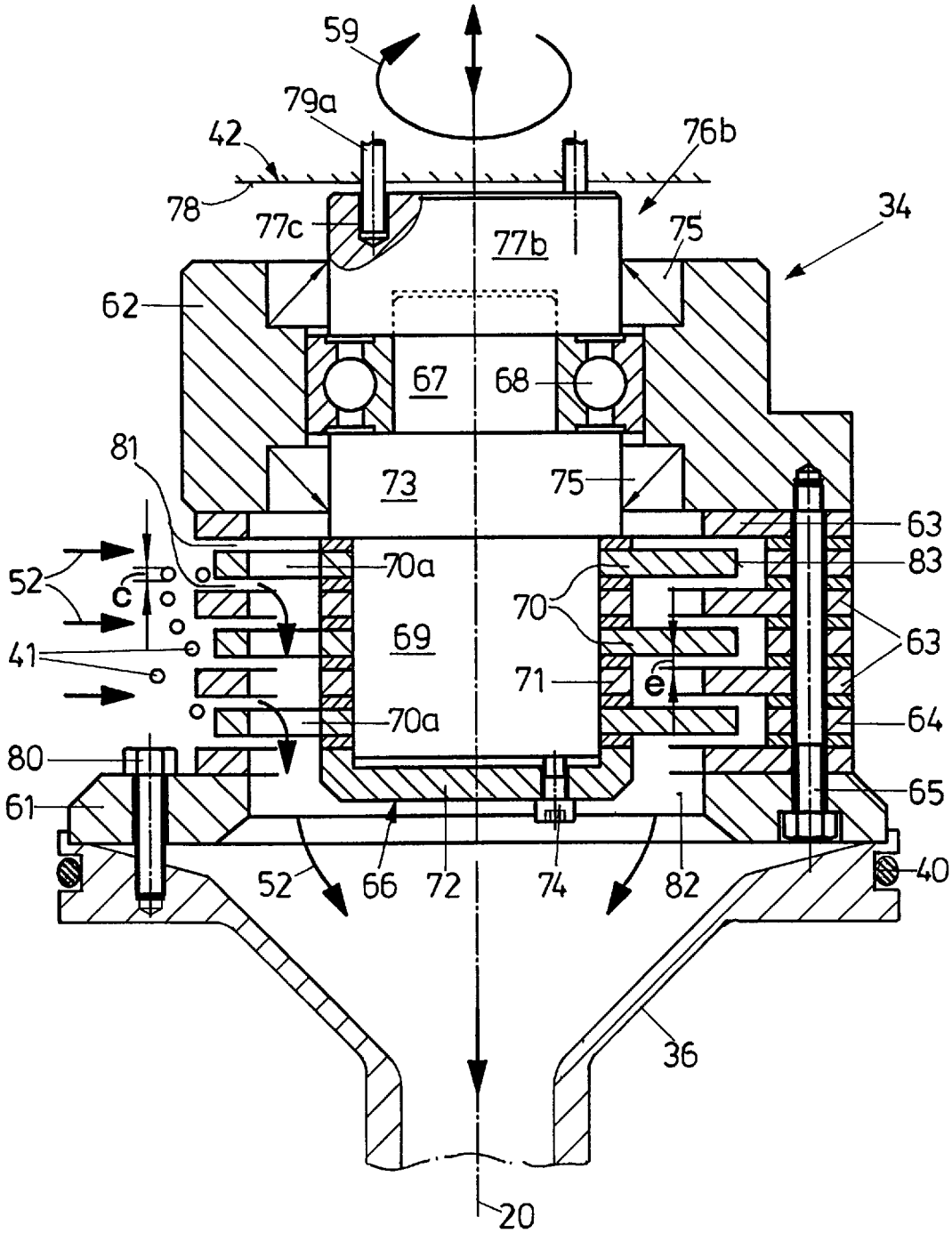
FIG. 4 is an identical illustration of a slightly modified embodiment of the separating device.

The separating device 34 according to FIG. 4 differs from that according to FIGS. 2 and 3 only by the design of the plug-in coupling 76*b*. In this case the coupling member 77*b* has bolts 77*c* with which engages an opposed coupling member 79*a* in the form of driving pins which is mounted on the inner front side 78 of the rotor 42 turned towards the coupling member 77*b*.

Figure 5:
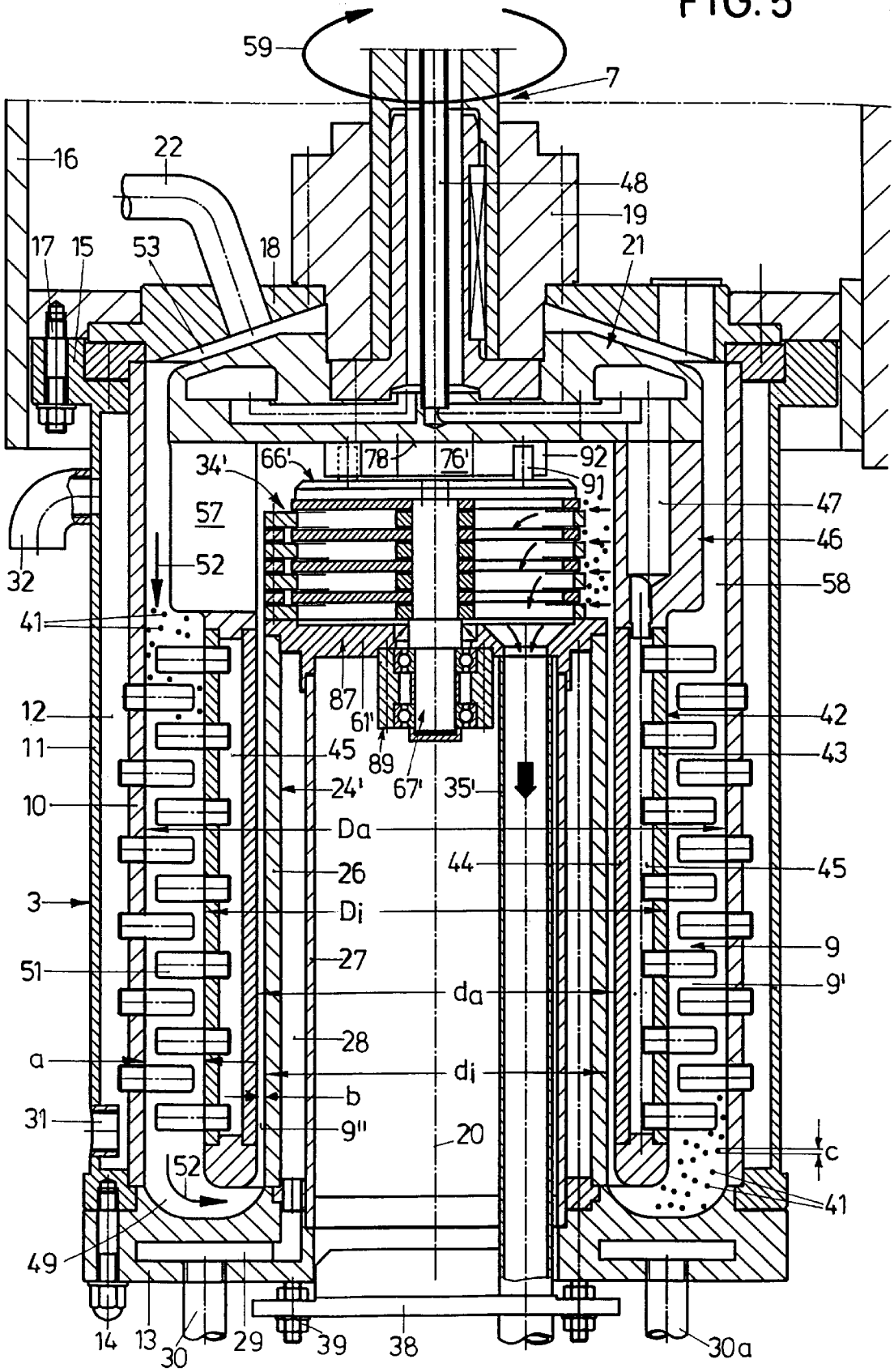
FIG. 5 is a lengthwise section, basically corresponding to FIG. 2, through the grinding receptacle of the agitator mill with a separating device modified as compared to FIGS. 2 to 4.
Figure 6:
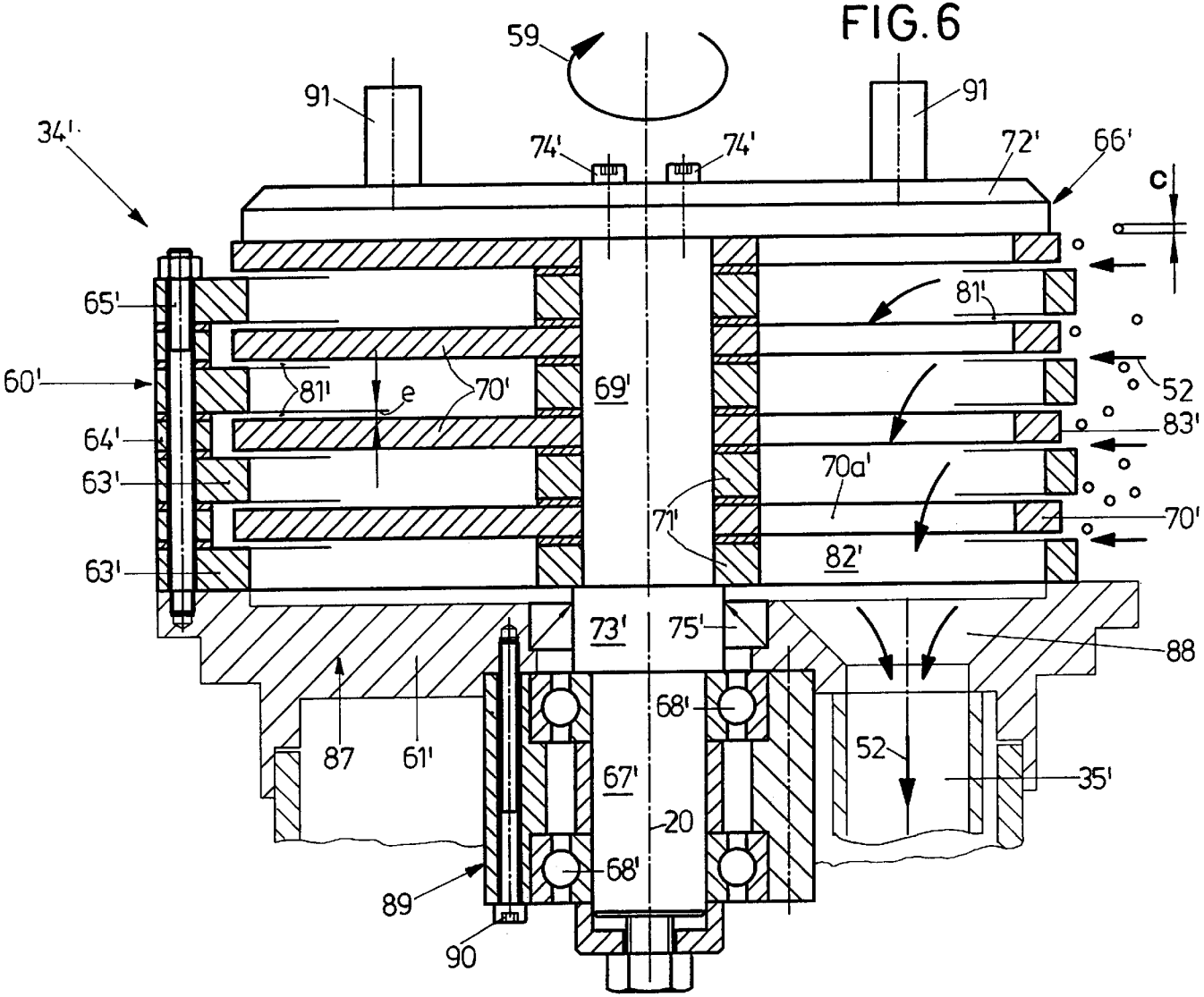
FIG. 6 is a lengthwise section, on an enlarged scale as opposed to FIG. 5, through the separating device of the agitator mill according to FIG. 5.

The agitator mill according to FIGS. 5 and 6 differs from that according to FIGS. 2 and 3 substantially by the design of the separating device 34' and partially by the design of the interior stator 24'. As far as identical parts are available, the same reference numerals are used as in FIG. 2, there being no need of renewed description. At its end turned toward the separating device 34', the interior stator 24' is closed toward the grinding chamber 9 by means of an interior stator cover 87, a hopper-type outlet 88 being formed in this cover 87, which is followed by a grinding stock discharge line 35' which is extended out of the grinding receptacle 3 in parallel to the axis 20 but not concentrically thereto. The interior stator cover 87 is simultaneously the bottom flange 61' of the housing 60' of the separating device 34'. Like the above described housing 60, this housing 60' is substantially built of outer annular disks 63' which are disposed concentrically of the axis 20, having spacers 64' placed in between them. This package is screwed to the bottom flange 61' by means of screws 65'.

The rotary body 66' of the separating device 34' comprises a shaft 67' which is lodged in a bearing housing 89 by means of several bearings 68', the bearing housing 89 being releasably fixed by screws 90 to the bottom flange 61' on the latter's side turned away from the grinding chamber 9. This bearing housing 89 is located on that side of the bottom flange 61' which the discharge line 35' is connected to. The shaft 67' is sealed toward the bearing housing 89 by means of a seal 75' which is disposed between an annular collar 73' of the shaft 67' and the bottom flange 61. Disposed on a journal 69' of the shaft 67' are inner annular disks 70' with holes 70a' between which spacers 71' are disposed. This package of inner annular disks 70' and spacers 71' is clamped against the annular collar 73' by means of a clamping cover 72', to which end the clamping cover 72' is fixed to the jounal 69' by means of screws 74'. What has been said above also applies to the width e of the separating gap 81' between an outer annular disk 63' and an inner annular disk 70' and the effect of the inner annular disks 70' driven in rotation.

It is true for both the embodiment according to FIGS. 5 and 6 and the embodiment according to FIGS. 2 and 3 that positive fit can be produced for rotary drive between the rotary body 66' and the rotor 42 by means of a plug-in coupling 76'. To this end, journal-type coupling members 91 are mounted on that side of the clamping cover 72' which is turned towards the inner front side 78 of the rotor 42, engaging with opposite coupling members 92 mounted on the inner front side 78 of the rotor 42. When the rotor 42 and the grinding receptacle 3 are moved apart, the coupling members 91 and the opposite coupling member 92 disengage, whereas they engage when same are moved together so that in this case too the rotary body 66' of the separating device 34' is driven at the speed of the rotor 42.

The agitator mill described can be disposed vertically or horizontally, i.e. it may have a vertical central longitudinal axis 20—as described—or a correspondingly horizontal central longitudinal axis.

Of course, the agitator mill may also be designed such that not only the interior grinding chamber, but also the exterior grinding chamber is in the form of an annular gap as illustrates and describes U.S. patent application Ser. No. 08/906,043 now U.S. Pat. No. 5,950,942. The same applies to an embodiment according to U.S. Pat. No. 5,062,577, in which the interior grinding chamber and the exterior grinding chamber have about the same width as the exterior grinding chamber specified above.

Further, it is conceivable that the specified coupling between the rotor and the separating device is used also in agitator mills as they are known from U.S. Pat. No. 4,620,673 or PCT WO 90/07378 or PCT WO 86/02286.

What is claimed is:

1. An agitator mill for the treatment of free flowing grinding stick, comprising:

a grinding receptacle (3), which defines a substantially closed grinding chamber (9) partially filled with auxiliary grinding bodies (41);

an agitator unit (21), which is disposed rotatingly drivably in the grinding receptacle (3) and is cup-shaped relative to a common central longitudinal axis (20) and which comprises an annular cylindrical rotor (42);

an interior stator (24, 24') disposed within said rotor (42) and joined to the grinding receptacle (3);

a grinding stock supply line (22) opening into the grinding chamber (9) outside the rotor (42);

a grinding stock and auxiliary grinding body separating device (34, 34') being mounted on the interior stator (24, 24') within the rotor (42), the separating device (34, 34') having outer annular disks (63, 63') and inner annular disks (70, 70'), which alternate with one another in the direction of the central longitudinal axis (20), defining separating gaps (81, 81') between them, the width (e) of which is less than the diameter (c) of the auxiliary grinding bodies (41); and a grinding stock discharge line (35, 35') connected to said separating device (34, 34');

wherein the inner annular disks (70, 70') are fixed to a rotary body (66, 66'), which is rotary about the central longitudinal axis (20) and which is separate from the rotor (42);

wherein the outer annular disks (63, 63') are non-rotary and not movable relative to the inner disks (70, 70') in the direction of the central longitudinal axis (20); and wherein the rotary body (66, 66') is rotatingly drivably coupled with said rotor (42).

2. An agitator mill according to claim 1, wherein the rotor (42) and the rotary body (66, 66') of the separating device (34, 34') are coupled with one another, having positive fit.

3. An agitator mill according to claim 1, wherein the rotor (42) and the rotary body (66, 66') of the separating device (34, 34') are non-positively coupled with one another.

4. An agitator mill according to claim 1, wherein a plug-in coupling (76, 76') is formed between the rotor (42) and the separating device (34, 34').

5. An agitator mill according to claim 1, wherein the separating device (34) is extractable outwards out of the interior stator (24).

6. An agitator mill according to claim 1, wherein the separating device (34') is tightly but releasably connected to the interior stator (24').

7. An agitator mill for the treatment of free flowing grinding stick, comprising:

a grinding receptacle (3), which defines a substantially closed grinding chamber (9) partially filled with auxiliary grinding bodies (41);

an agitator unit (21), which is disposed rotatingly drivably in the grinding receptacle (3) and is cup-shaped relative to a common central longitudinal axis (20) and which comprises an annular cylindrical rotor (42);

an interior stator (24, 24') disposed within said rotor (42) and joined to the grinding receptacle (3);

a grinding stock supply line (22) opening into the grinding chamber (9) outside the rotor (42);

a grinding stock and auxiliary grinding body separating device (34, 34') being mounted on the interior stator (24, 24') within the rotor (42), the separating device (34, 34') having outer annular disks (63, 63') and inner annular disks (70, 70'), which alternate with one another in the direction of the central longitudinal axis (20), defining separating gaps (81, 81') between them, the width (e) of which is less than the diameter (c) of the auxiliary grinding bodies (41); and a grinding stock discharge line (35, 35') connected to said separating device (34, 34');

wherein the inner annular disks (70, 70') are fixed to a rotary body (66, 66'), which is rotary about the central longitudinal axis (20) and which is separable from the rotor (42);

wherein the outer annular disks (63, 63') are non-rotary and not movable relative to the inner disks (70, 70') in the direction of the central longitudinal axis (20); and wherein the rotary body (66, 66') is rotatingly drivably coupled with said rotor (42);

wherein the rotary body (66, 66') is provided with at least one coupling member (77, 91) and an inner front side (78), facing same, of the rotor (42) is provided with at least one opposite coupling member (79, 92), which is engageable and disengageable by a motion of the rotor (42) relative to the separating device (34, 34') in the direction of the central longitudinal axis (20);

wherein the grinding body separating device (34, 34') and the rotor (42) are movable apart from each other in the direction of the central longitudinal axis (20).

8. An agitator mill according to claim 7, wherein the rotor (42) and the rotary body (66, 66') of the separating device (34, 34') are coupled with one another, having positive fit.

9. An agitator mill according to claim 7, wherein the rotor (42) and the rotary body (66, 66') of the separating device (34, 34') are non-positively coupled with another.

10. An agitator mill according to claim 7, wherein a plug-in coupling (76, 76') is formed between the rotor (42) and the separating device (34, 34').

11. An agitator mill according to claim 7, wherein the separating device (34) is extractable outwards out of the interior stator (24).

12. An agitator mill according to claim 7, wherein the separating device (34') is tightly but releasably connected to the interior stator (24').

* * * * *